US008087668B2

(12) United States Patent
Taniguchi

(10) Patent No.: US 8,087,668 B2
(45) Date of Patent: Jan. 3, 2012

(54) TRANSPORT DIVERTER AND PAPER SHEET PROCESSING UNIT

(75) Inventor: Tetsuya Taniguchi, Himeji (JP)

(73) Assignee: Glory Ltd., Himeji-Shi, Hyogo (JP)

( * ) Notice: Subject to any disclaimer, the term of this patent is extended or adjusted under 35 U.S.C. 154(b) by 0 days.

(21) Appl. No.: 12/531,007

(22) PCT Filed: Apr. 17, 2008

(86) PCT No.: PCT/JP2008/057471

§ 371 (c)(1),
(2), (4) Date: Sep. 11, 2009

(87) PCT Pub. No.: WO2008/139823

PCT Pub. Date: Nov. 20, 2008

(65) Prior Publication Data

US 2010/0090397 A1 Apr. 15, 2010

(30) Foreign Application Priority Data

May 9, 2007 (JP) ..... 2007-124890

(51) Int. Cl.
*B65H 5/00* (2006.01)

(52) U.S. Cl. ..... 271/225; 271/184; 271/303

(58) Field of Classification Search ..... 271/303, 271/225, 184

See application file for complete search history.

(56) References Cited

U.S. PATENT DOCUMENTS

| | | | | |
|---|---|---|---|---|
| 6,170,818 | B1 * | 1/2001 | Eastman et al. | 271/184 |
| 7,108,260 | B2 * | 9/2006 | Biegelsen et al. | 271/303 |

FOREIGN PATENT DOCUMENTS

| | | | |
|---|---|---|---|
| EP | 0915426 | A2 | 5/1999 |
| JP | 61-064641 | A | 4/1986 |
| JP | 63-176261 | A | 7/1988 |
| JP | 64-081757 | | 3/1989 |
| JP | 07-187470 | | 7/1995 |
| JP | 08-002774 | A | 1/1996 |
| JP | 2005-335832 | A | 12/2005 |
| JP | 2006-199452 | A | 8/2006 |

* cited by examiner

*Primary Examiner* — Michael McCullough
(74) *Attorney, Agent, or Firm* — Renner, Kenner, Greive, Bobak, Taylor & Weber

(57) ABSTRACT

A conveying and dividing mechanism in which a first conveyance path and a second conveyance path facing each other can bidirectionally convey banknotes between each other and that can divide into multiple-direction banknotes conveyed from both the first conveyance path and the second conveyance path. A first dividing member is rockably provided at the intersection of the first conveyance path, the second conveyance path, a third conveyance path, and a fourth conveyance path. The first dividing member enables banknotes to be bidirectionally conveyed between the first and second conveyance paths. Further, the first dividing member enables bank notes conveyed from the first and second conveyance paths to be divided into the third and fourth conveyance paths.

4 Claims, 10 Drawing Sheets

PROIR ART

TRANSPORT DIVERTER AND PAPER SHEET PROCESSING UNIT

This application is a US National Phase Application under 35 U.S.C. §371 of International Patent Application No. PCT/JP2008/057471 filed Apr. 17, 2008, which claims priority to and the benefit of Japanese Patent Application No. 2007-124890, filed May 9, 2007, each of which are hereby incorporated by reference in their entireties. The International Application published as WO 2008/139823A1 on Nov. 20, 2008.

TECHNICAL FIELD

The present invention relates to a transport diverter for diverting transported paper sheets and a paper sheet processing unit using the transport diverter.

BACKGROUND ART

In a paper sheet depositing unit for subjecting banknotes as paper sheets to a depositing process, a transport passage has been conventionally constituted by two-directional diverters for transporting banknotes in multiple directions. When the transport passage is thus constituted by the two-directional diverters, many two-directional diverters are required to be provided, thereby causing an increase in cost or enlarging a space to be occupied.

The constitution of such a conventional banknote depositing unit is shown in FIG. 11.

In the depositing process of the conventional banknote depositing unit, banknotes, which are put in an inlet portion 1 with the banknotes piled up, pass a reject unit 2 and are transported to a feeding unit 3 as they are, are separated one by one from the feeding unit 3 and fed to a transport path 4, and recognized by a recognition unit 5 on the transport path 4.

Banknotes each recognized as a normal banknote by the recognition unit 5 are transported and escrowed in an escrow unit 6 through the transport path 4.

Banknotes each recognized as a rejected banknote such as a non-banknote by the recognition unit 5 are transported and stored in the reject unit 2 through the transport path 4, and collectively returned from the reject unit 2 to the inlet portion 1.

Banknotes each recognized as a counterfeit banknote by the recognition unit 5 are escrowed in the escrow unit 6 together with normal banknotes, fed from the escrow unit 6 to the transport path 4 in storing or returning escrowed banknotes, and then transported and stored in a taking-in box 7 through the transport path 4.

After completion of escrow of put-in banknotes, banknotes escrowed in the escrow unit 6 are fed to the transport path 4 one by one in accordance with a storing instruction from a higher-ranking machine. Banknotes, each which is recognized as a normal banknote based on the order of escrow in the escrow unit 6 among the banknotes fed one by one from the escrow unit 6, are transported and stored in either of two cassettes 8 through the transport path 4, and counterfeit banknotes are transported and stored in the taking-in box 7 through the transport path 4.

After completion of escrow of put-in banknotes, banknotes escrowed in the escrow unit 6 are fed to the transport path 4 one by one in accordance with a returning instruction from the higher-ranking machine. Banknotes, each which is recognized as a normal banknote based on the order of escrow in the escrow unit 6 among the banknotes fed one by one from the escrow unit 6, are transported and stored in the reject unit 2 through the transport path 4, and collectively returned to the inlet portion 1 from the reject unit 2, and counterfeit banknotes are transported and stored in the taking-in box 7 through the transport path 4.

Additionally, when banknotes returned to the inlet portion 1 are not taken out and remain therein, they are collected as banknotes forgotten to be taken out. That is, banknotes, which are forgotten to be taken out, in the inlet portion 1 pass the reject unit 2 with the banknotes piled up and are transported to the feeding unit 3, separated one by one from the feeding unit 3 and fed to the transport path 4, and transported and stored in the taking-in box 7 through a path dedicated to forgetting to take out 4*a* diverted on this side of the recognition unit 5 on the transport path 4.

Additionally, a plurality of two-directional diverters 9*a* to 9*g* are used for the transport path 4 for transporting banknotes in multiple directions. That is, the diverter 9*a* is disposed at a switching position of switching a transporting direction to a direction of transporting banknotes from the transport path 4 to the reject unit 2, the diverter 9*b* is disposed at a diverting position of diverting banknotes fed from the feeding unit 3 to the recognition unit 5 side of the transport path 4 and the path dedicated to forgetting to take out 4*a*, the diverter 9*c* is disposed at a switching position of switching a transport destination of banknotes fed from the escrow unit 6 to the transport path 4 to the cassette 8 and the taking-in box 7 side, the diverter 9*d* is disposed at a diverting position of diverting banknotes having passed the recognition unit 5 to the escrow unit 6 side and the reject unit 2 side, the diverter 9*e* is disposed at a diverting position of diverting banknotes fed from the escrow unit 6 to the transport path 4 to the cassette 8, the taking-in box 7 side and the reject unit 2 side, and the diverters 9*f* and 9*g* are disposed at a diverting position for diverting banknotes to the taking-in box 7 and each cassette 8.

As described above, in the conventional banknote depositing unit, the plurality of two-directional diverters 9*a* to 9*g* must be combined with each other for transporting banknotes in the multiple directions. Accordingly, the two-directional diverters 9*a* to 9*g* are required to be provided in accordance with the number of times of diverting or switching, thereby causing an increase in cost, and many places for providing the two-directional diverters 9*a* to 9*g* are required, thereby enlarging a space to be occupied.

Since a space to be occupied is enlarged in the conventional banknote depositing unit, the diverter 9*b* cannot be provided between the recognition unit 5 and the diverter 9*c* and is provided in front of the recognition unit 5. Thus, the path dedicated to forgetting to take out 4*a* used for only transporting banknotes forgotten to be taken out must be provided, thereby causing an increase in cost and the necessary space required.

Since, in taking counterfeit banknotes into the taking-in box 7, the counterfeit banknotes are stored in the escrow unit 6 together with normal banknotes with memorization of the order of storage thereof, separated from the normal banknotes when being fed from the escrow unit 6, and stored in the taking-in box 7, transport control of banknotes becomes complicated. The reason why such a constitution is adopted is that counterfeit banknotes, in the case of being directly stored in the taking-in box 7 after recognition, are required to be diverted and sent to the taking-in box 7 after being transported through the transport path 4 for a time until confirmation of a recognition result, and thus a diverter and transport path dedicated to taking in counterfeit banknotes are required, thereby causing an increase in cost and the necessary space required.

On the other hand, a constitution is known in which paper sheets can be diverted in multiple directions by one transport diverter so that the number of installation places of two-directional diverters is reduced.

For example, there exists a transport diverter in which a diverting gate is rotatably provided at a cross point of transport paths in three directions, a rotation position of the diverting gate is controlled and paper sheets can be diverted in the transport paths in the three directions (see, for example, Patent Document 1). By using the transport diverter for a banknote depositing unit, a plurality of installation places of two-directional diverters can be combined into one place and the number thereof can be reduced.

Additionally, there exists a transport diverter which has a hollow diversion unit swingably provided between a transport path on a transporting-in side, into which sheets are transported, and three transport paths on a transporting-out side for diverting transported sheets, and controls a swing position of the diversion unit to divert sheets, which are transported from the transport path on the transporting-in side, to one transport path on the transporting-out side through the inside of the diversion unit, or to the other transport paths on the transporting-out side through both side outer faces of the diversion unit (see, for example, Patent Document 2). By using the transport diverter for a banknote depositing unit, a plurality of installation places of two-directional diverters can be combined into one place and the number thereof can be reduced.

Patent Document 1: Japanese Patent Publication No. 2742205 (p. 2, FIG. 2)

Patent Document 2: Japanese Laid-open Patent Publication No. 2006-199452 (p. 5, FIG. 5)

DISCLOSURE OF THE INVENTION

Problems to be Solved by the Invention

However, in the transport diverter disclosed in Patent Document 1, paper sheets transported to the transport diverter from one transport path can be diverted only in two directions. Thus, even if the transport diverter is used for transport paths of a banknote depositing unit, reduction in the number of installation places of two-directional diverters is limited, and it is difficult to combine a further larger number of installation places into one place and reduce the number of installation places.

Additionally, in the transport diverter disclosed in Patent Document 2, sheets transported from a transport path on a transporting-in side are only diverted to three-directional transport paths on a transporting-out side and cannot be bidirectionally transported. Thus, even if the transport diverter is used for transport paths of a banknote depositing unit, reduction in the number of installation places of two-directional diverters is limited, it is difficult to combine a further large number of installation places into one place and reduce the number of installation places.

The present invention has been made in view of the above problems and aims to provide a transport diverter capable of reducing the number of installation places of two-directional diverters, and a paper sheet processing unit using the transport diverter, the unit being capable of being downsized by making a necessary occupied space for diversion small, of simplifying transport control of banknotes and of reducing cost.

Means to Solve the Problems

A transport diverter of claim 1 of the present invention is a transport diverter for diverting transported paper sheets, and includes: a first transport path; a second transport path which is opposite to the first transport path and from/to which paper sheets can be transported to/from the first transport path; a third transport path for transporting paper sheets which are diverted, at a connection point between the first transport path and the second transport path, to one side in a direction crossing a facing direction of the first transport path and the second transport path; a fourth transport path for transporting paper sheets which are diverted, at the connection point, to the other side in the direction crossing the facing direction of the first transport path and the second transport path; a diversion unit which is swingably provided at the connection point and has a pair of diversion members provided opposite to each other, the pair of diversion members having inner faces facing each other and outer faces opposite from the inner faces, the faces each serving as a transporting face of paper sheets; a driving unit for swinging the diversion unit; and a control unit for controlling the driving unit to switch a stopping position of the diversion unit to a position of forming a first transport passage for transporting paper sheets from the first transport path to the second transport path, and a second transport passage for transporting paper sheets from the second transport path to the first transport path between the inner face of the first diversion member and the inner face of the second diversion member of the diversion unit, a position of forming a third transport passage for transporting paper sheets from the first transport path to the third transport path along the outer face of the first diversion member of the diversion unit, and a fourth transport passage for transporting paper sheets from the second transport path to the fourth transport path along the outer face of the second diversion member of the diversion unit, and a position for forming a fifth transport passage for transporting paper sheets from the first transport path to the fourth transport path along the outer face of the second diversion member of the diversion unit, and a sixth transport passage for transporting paper sheets from the second transport path to the third transport path along the outer face of the first diversion member of the diversion unit, and for diverting paper sheets, which are transported from the first transport path and the second transport path, in three directions.

A transport diverter of claim 2 of the present invention is a transport diverter for diverting transported paper sheets, and includes: a first transport path; a second transport path which is opposite to the first transport path and from/to which paper sheets can be transported to/from the first transport path; a third transport path for transporting paper sheets which are diverted, at a connection point between the first transport path and the second transport path, to one side in a direction crossing a facing direction of the first transport path and the second transport path; a fourth transport path for transporting paper sheets which are diverted, at the connection point, to the other side in the direction crossing the facing direction of the first transport path and the second transport path; a first diversion unit which is swingably provided at the connection point and has a pair of diversion members provided opposite to each other, the pair of diversion members having inner faces facing each other and outer faces opposite from the inner faces, the faces each serving as a transporting face of paper sheets; a second diversion unit provided between the first diversion unit and the third transport path, and having side faces each serving as a transporting face of paper sheets; a third diversion unit provided between the first diversion unit and the fourth transport path, and having side faces each serving as a transporting face of paper sheets; a driving unit for swinging the first diversion unit; and a control unit for controlling the driving unit to switch a stopping position of the first diversion unit to a position of forming a first transport passage for transporting paper sheets from the first transport path to the second transport path, and a second transport passage for transporting paper sheets from the second transport path to the first transport path between the inner face of the first diversion member and the inner face of the second diversion member of the first diversion unit, a position of forming a third transport passage for transporting paper sheets from the first transport path to the third transport path along the outer face of the first diversion member of the first diversion unit and the side face of the second diversion unit, and a fourth transport passage for transporting paper sheets from the second transport path to the fourth transport path along the outer face of the second diversion member of the first diversion unit and the side face of the third diversion unit, and a position for forming a fifth transport passage for transporting paper sheets from the first transport path to the fourth transport path along the outer face of the second diversion member of the first diversion unit and the side face of the third diversion unit, and a sixth transport passage for transporting paper sheets from the second transport path to the third transport path along the outer face of the first diversion member of the first diversion unit and the side face of the second diversion unit, and for diverting paper sheets, which are transported from the first transport path and the second transport path, in three directions.

With a transport diverter of claim 3 of the present invention, in the transport diverter of claim 2, paper sheets can be transported from/to at least one of the third and fourth transport paths to/from the first transport path and the second transport path, at least one of the second and third diversion units is swingably provided, and paper sheets transported from at least one of the third and fourth transport paths can be diverted to the first transport path and the second transport path.

A paper sheet processing unit of claim 4 of the present invention is a paper sheet processing unit for recognizing put-in paper sheets and determining a transport destination of a paper sheet in accordance with a recognition result, the paper sheet processing unit including a transport path for transporting put-in paper sheets, a recognition unit for recognizing paper sheets transported through the transport path, and the transport diverter according to any of claims 1 to 3 which is provided on the transport path and diverts a paper sheet, which has been recognized by the recognition unit, in accordance with its transport destination.

Effect of the Invention

According to a transport diverter of claim 1 of the present invention, a plurality of installation places of two-directional diverters can be combined into one place and the number of installation places can be reduced by applying the transport diverter to, for example, a paper sheet processing unit, because a swingable diversion unit allows paper sheets to be transported from/to a first transport path to/from a second transport path, the paths facing each other, and paper sheets transported from the first/second transport path to be diverted in three directions including a third transport path and a fourth transport path.

According to a transport diverter of claim 2 of the present invention, a plurality of installation places of two-directional diverters can be combined into one place and the number of installation places can be reduced by applying the transport diverter to, for example, a paper sheet processing unit, because a first swingable diversion unit allows paper sheets to be transported from/to a first transport path to/from a second transport path, the paths facing each other, and paper sheets transported from the first/second transport path to be diverted in multiple directions including a third transport path and a fourth transport path. Additionally, by using a second diversion unit and a third diversion unit with the first swingable diversion unit, paper sheets diverted by the first diversion unit can be reliably diverted to the third transport path and the fourth transport path through the second diversion unit and the third diversion unit.

According to a transport diverter of claim 3 of the present invention, in addition to the effect of the transport diverter of claim 2, paper sheets can be diverted in further multiple directions, because at least one of the second and third diversion units is swingable and paper sheets transported from at least one of the third and fourth transport paths can be diverted to the first transport path and the second transport path.

According to a paper sheet processing unit of claim 4 of the present invention, a plurality of installation places of two-directional diverters can be combined into one place, the number of installation places can be reduced, an occupied space conventionally required for diversion can be made small, the processing unit can be downsized, transport control can be simplified and cost can be reduced, because a paper sheet, which has been recognized by the a recognition unit, can be diverted in accordance with its transport destination by using the transport diverter of any of claims 1 to 3.

REFERENCE NUMERALS

Figure 1:
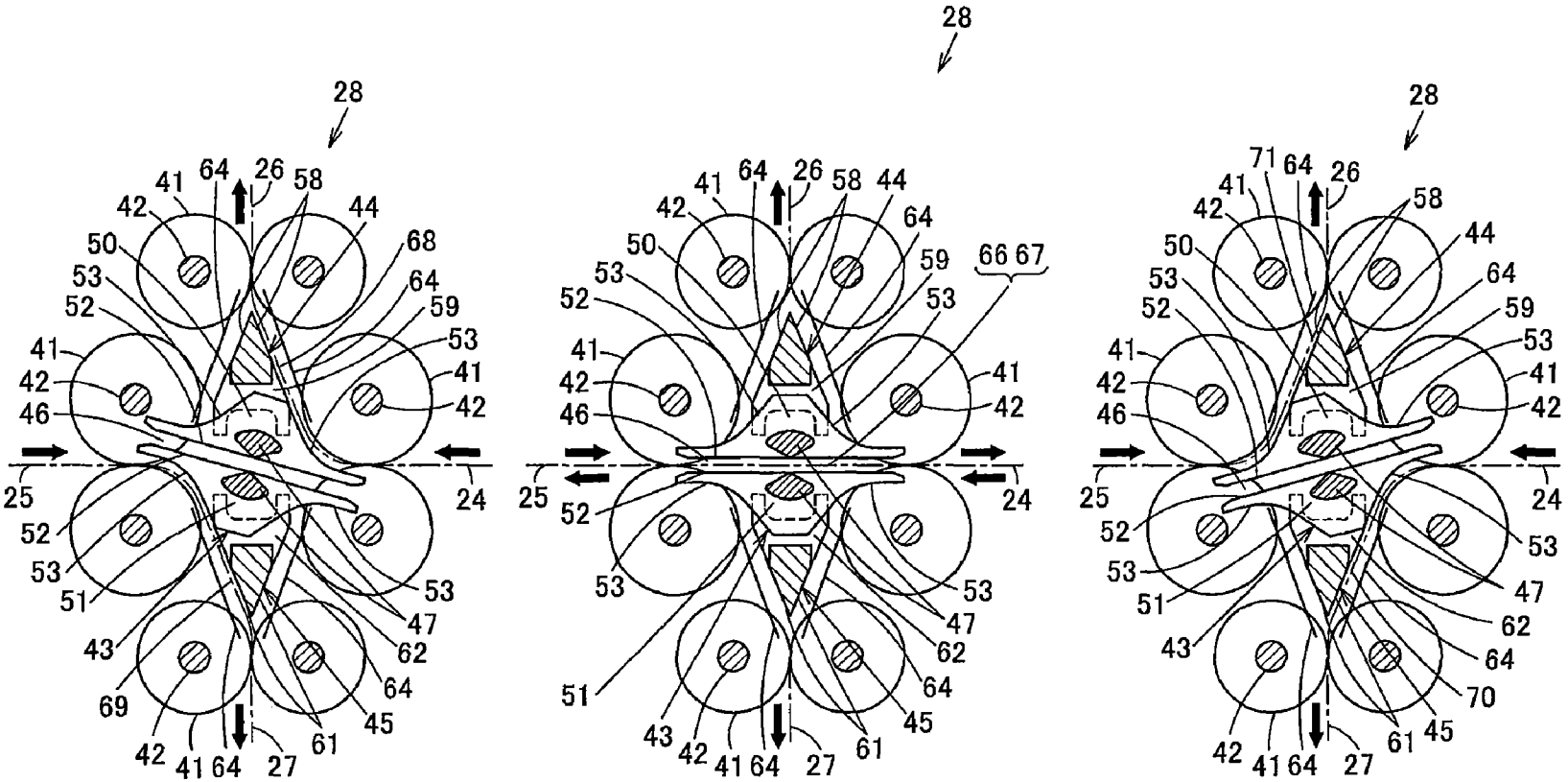
FIG. 1 shows a first embodiment of the present invention, and FIGS. 1(*a*), (*b*) and (*c*) each is a cross sectional view showing a switching state of each transport passage by a transport diverter.

11 Banknote depositing unit as paper sheet processing unit
15 Transport path
19 Recognition unit
24 First transport path
25 Second transport path
26 Third transport path
27 Fourth transport path
28 Transport diverter
43 First diversion unit as diversion unit
44 Second diversion unit
45 Third diversion unit

50 First diversion member
51 Second diversion member
52 Inner face
53 Outer face
54 Driving unit
58, 61 Side face
66 First transport passage
67 Second transport passage
68 Third transport passage
69 Fourth transport passage
70 Fifth transport passage
71 Sixth transport passage
81 Control unit

BEST MODE FOR CARRYING OUT THE INVENTION

Hereinafter, embodiments of the present invention will be described with reference to the drawings.

FIGS. 1 to 8 show a first embodiment.

Figure 4:
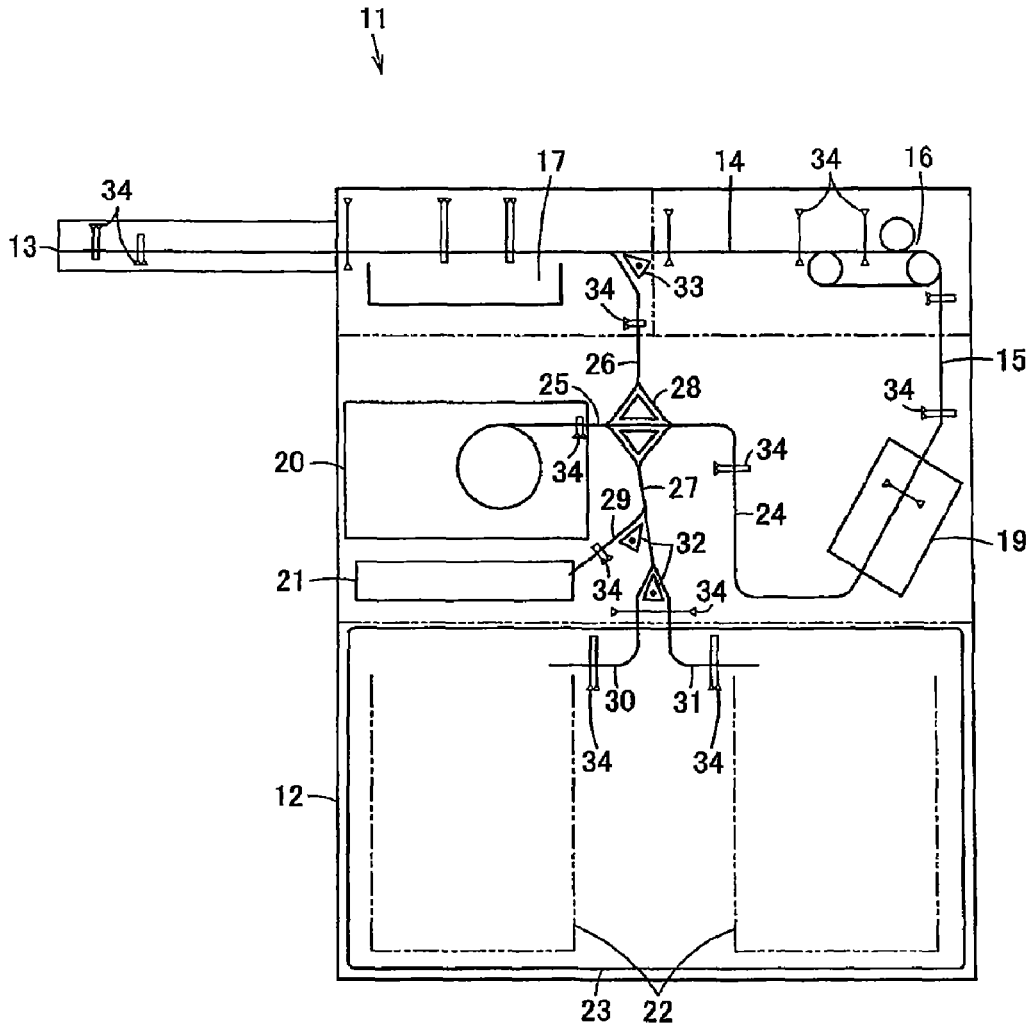
FIG. 4 is a cross sectional view showing an inner structure of a paper sheet processing unit to which the transport diverter is applied.

In FIG. 4, the reference numeral 11 denotes a banknote depositing unit as a paper sheet processing unit, and the banknote depositing unit 11 subjects banknotes as paper sheets to a depositing process.

An inlet portion 13, into which a plurality of banknotes can be collectively inserted with the banknotes piled up, stacked, is formed at a front face of an upper part of a unit body 12 of the banknote depositing unit 11, and a transport path 14 for transporting stacked banknotes to a rear part in the unit body 12 from the inlet portion 13 is formed in the upper part of the unit body 12. A feeding unit 16 for separating and feeding the stacked banknotes one by one to a transport path 15 disposed in the unit body 12 is disposed at a rear part of the transport path 14. A reject unit 17 for stacking banknotes such as a rejected banknote and banknote to be returned fed from the transport path 15 is disposed between the inlet portion 13 and the feeding unit 16 at the transport path 14. Banknotes stacked in the reject unit 17 are transported and can be returned to the inlet portion 13 as they are through the transport path 14.

The transport path 15 for transporting banknotes fed one by one from the feeding unit 16 is disposed on the lower side, in relation to the transport path 14, in the unit body 12, a recognition unit 19 is connected to the transport path 15 and disposed in the rear part in the unit body 12, an escrow unit 20 and a taking-in box 21, which are storing and transporting-out units respectively, are disposed in the front of the unit body 12, and a storing cassette unit 23, in which a plurality of storing units 22 are arranged, is disposed in a lower part in the unit body 12.

The transport path 15 includes: a first transport path 24 connected to the recognition unit 19; a second transport path 25 connected to the escrow unit 20; a third transport path 26 directed to the reject unit 17 and connected to the transport path 14; and a fourth transport path 27 indirectly connected to the taking-in box 21 and the storing units 22. A transport diverter 28 for diverting transported banknotes is disposed at a cross point, connection point, of the first to fourth transport paths 24 to 27. A fifth transport path 29 connected to the taking-in box 21 is connected to the fourth transport path 27, a sixth transport path 30 and a seventh transport path 31 connected to the storing units 22 respectively are connected to the fourth transport path 27, and a two-directional diverter 32 is disposed at each diversion position. The first transport path 24 includes a transporter for transporting banknotes to the transport diverter 28, the second transport path 25 includes a transporter for bidirectionally transporting banknotes in relation to the transport diverter 28, the third transport path 26 includes a transporter for transporting banknotes from the transport diverter 28 to the transport path 14, and the fourth transport path 27 includes a transporter for transporting banknotes from the transport diverter 28 to the fifth to seventh transport paths 29 to 31.

The recognition unit 19 recognizes an authenticity and denomination of a banknote fed and transported from the feeding unit 16 to the transport path 15.

The escrow unit 20 escrows banknotes transported one by one through the transport path 15, and can feed the escrowed banknotes to the transport path 15 one by one in order reverse to the order of transported banknotes.

The taking-in box 21, through the transport paths 14 and 15, takes in and stores banknotes each recognized as a counterfeit banknote by the recognition unit 19 and banknotes returned to the inlet portion 13 and forgotten to be taken out.

The storing cassette unit 23 can be pulled out from the unit body 12, and the two storing units 22 are disposed in a front-rear direction of the unit body 12. Banknotes transported through the transport path 15 are vertically stacked and stored in each storing unit 22.

The transport diverter 28 can divert banknotes transported from the first transport path 24 to the second transport path 25, third transport path 26 and fourth transport path 27, and can divert banknotes transported from the second transport path 25 to the first transport path 24, third transport path 26 and fourth transport path 27.

Moreover, the length of the first transport path 24 between the recognition unit 19 and the transport diverter 28 is set so that a transport distance of banknotes corresponding to time necessary for confirmation of recognition result by the recognition unit 19 is ensured. Additionally, a switching mechanism 33 for sending banknotes to be transported to a reject unit 17 to the transport path 14 is disposed at a cross point of the third transport path 26 and the transport path 14.

Additionally, a plurality of banknote detecting units 34 are disposed at the inlet portion 13, transport path 14, transport path 15, etc., respectively.

Figure 2:
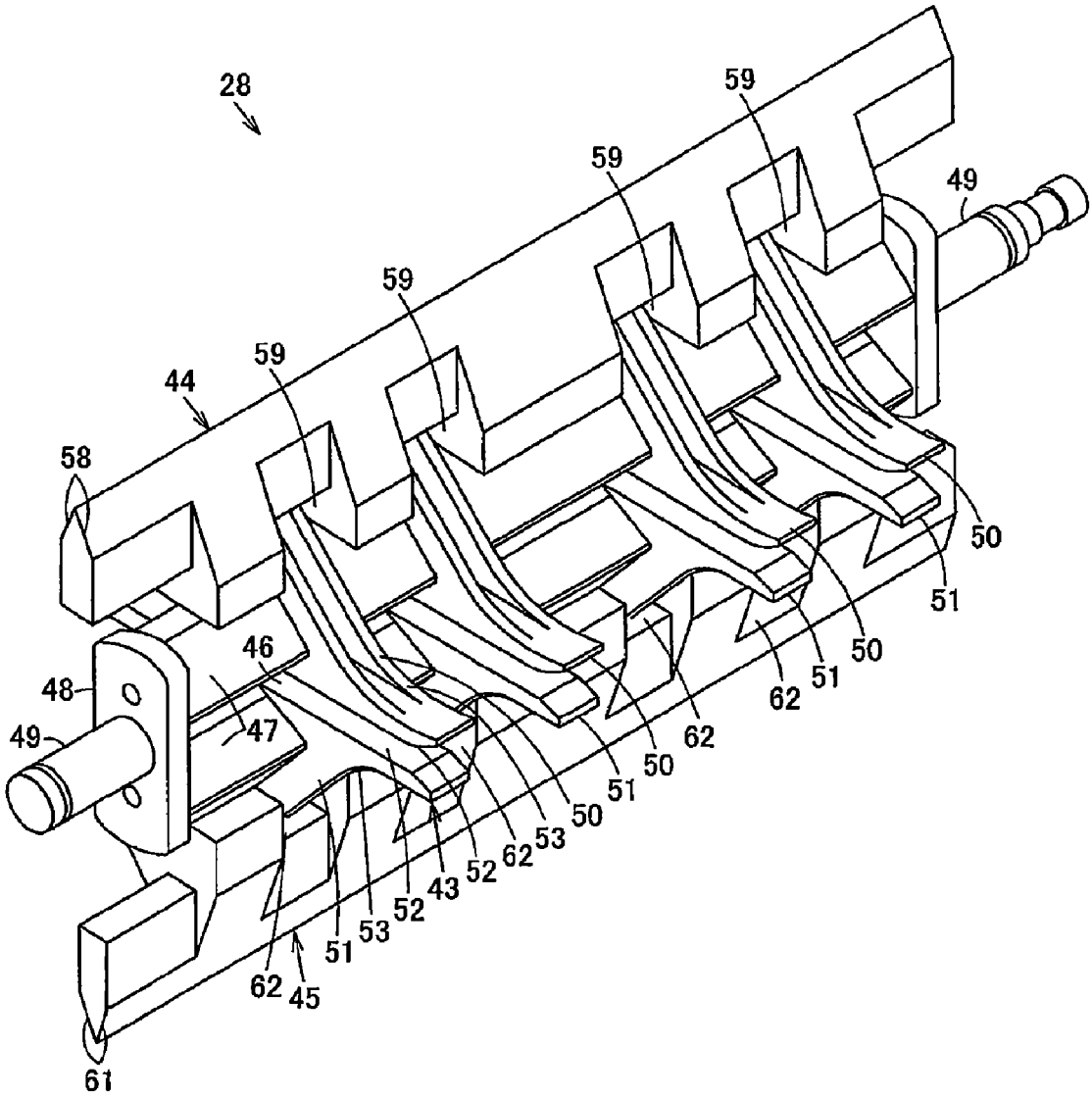
FIG. 2 is a perspective view of a part of the transport diverter.
Figure 3:
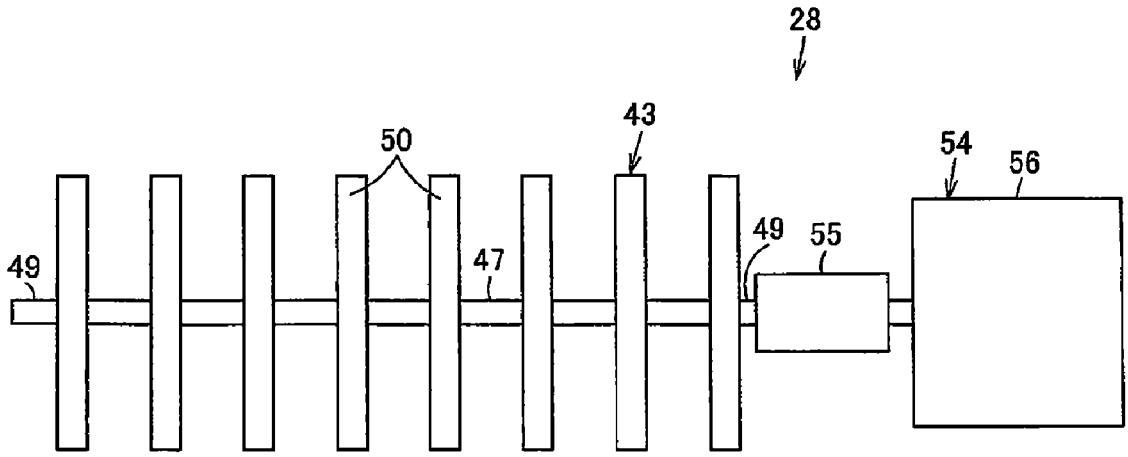
FIG. 3 is a plan view showing a driving structure of a first diversion unit of the transport diverter.

FIGS. 1 to 3 show the constitution of the transport diverter 28.

Pairs of transport rollers 41 each for clamping and transporting a banknote are disposed at each end of the first to fourth transport paths 24 to 27, the rollers 41 facing the cross point of the first to fourth transport paths 24 to 27. The transport roller 41 is rotatably supported around an axis 42, divided into a plurality of pieces in an axis direction of the axis 42, and the pieces are arranged at a predetermined interval.

A first diversion unit 43 as a diversion unit is provided at the cross point of the first to fourth transport paths 24 to 27, and between the transport rollers 41 of the first to fourth transport paths 24 to 27, a second diversion unit 44 is disposed between the first diversion unit 43 and the third transport path 26, and a third diversion unit 45 is disposed between the first diversion unit 43 and the fourth transport path 27.

The first diversion unit 43 has a pair of supporting units 47 arranged across a passage portion 46, through which banknotes can pass, ends at the same side of the supporting units 47 are integrally linked with each other by a linking plate 48, an axis portion 49 is projected on an outer face of each linking plate 48, and the first diversion unit 43 is swingable around the axis portions 49. Moreover, the axis portion 49 is arranged parallel with the axis 42 of the transport roller 41 in the axis direction.

On each of the pair of supporting units 47, the one diversion member (first diversion member) 50 and the other diversion member (second diversion member) 51 are disposed so as to integrally swing. The first diversion member 50 and the second diversion member 51 are respectively divided into a plurality of pieces in an axis direction of the supporting units 47, the piece of the diversion member 50 and piece of the diversion member 51 are disposed as a pair at the same position, the pairs are arranged at a predetermined interval, and a position of each pair corresponds to a gap position of the transport roller 41 in its axis direction. Thus, although a part of the first diversion unit 43 overlaps with the transport roller 41 when viewed from the axis direction, the first diversion unit 43 does not overlap with the transport roller 41 when viewed from a direction crossing the axis direction, and the first diversion unit 43 can be swung without interfering with the transport roller 41.

In the diversion members 50 and 51, inner faces 52 spaced apart from each other and facing parallel with each other are formed respectively, and outer faces 53 are formed respectively, each in which its center portion opposite from the inner face 52 is projected in a crest shape and both sides of the center portion are curved. The inner face 52 and the outer face 53 respectively serve as transporting faces for transporting banknotes.

A driving unit 54 for swinging the first diversion unit 43 is linked with the axis portion 49 at one end side of the first diversion unit 43. A stepping motor 56 having a driving axis linked with the axis portion 49 via a coupling 55 is used for the driving unit 54.

The second diversion unit 44 is arranged parallel with the first diversion unit 43 and formed so as to have a triangle cross section that a top end of the member 44 opposite to the third transport path 26 is an upper vertex, and side faces 58 each serving as a transport face of banknotes are formed at both sides of the triangle cross section. Notch portions 59 for preventing the second diversion unit 44 from interfering with the diversion member 50 of the first diversion unit 43 are formed at a face side of the second diversion unit 44 opposite to the first diversion unit 43.

Additionally, the third diversion unit 45 is arranged parallel with the first diversion unit 43 and formed so as to have a triangle cross section that a top end of the third diversion unit 45 opposite to the fourth transport path 27 is an upper vertex, and side faces 61 each serving as a transport face of banknotes are formed at both sides of the triangle cross section. Notch portions 62 for preventing the first diversion unit 43 from interfering with the diversion member 51 are formed at a face side of the third diversion unit 45 opposite to the first diversion unit 43.

Guides 64 for guiding banknotes to the third transport path 26 and the fourth transport path 27 are disposed opposite to the side faces 58 of the second diversion unit 44 and the side faces 61 of the third diversion unit 45.

By control of the stepping motor 56, a stopping position of the first diversion unit 43 is switched to: a first regular position of forming a first transport passage 66 for transporting banknotes from the first transport path 24 to the second transport path 25, and a second transport passage 67 for transporting banknotes from the second transport path 25 to the first transport path 24 between the inner face 52 of the first diversion member 50 and the inner face 52 of the second diversion member 51 of the first diversion unit 43 as shown in FIG. 1(*b*); a second regular position of forming a third transport passage 68 for transporting banknotes from the first transport path 24 to the third transport path 26 along the outer face 53 of the first diversion member 50 of the first diversion unit 43 and the side face 58 of the second diversion unit 44, and a fourth transport passage 69 for transporting banknotes from the second transport path 25 to the fourth transport path 27 along the outer face 53 of the second diversion member 51 of the first diversion unit 43 and the side face 61 of the third diversion unit 45 as shown in FIG. 1(*a*); and a third regular position of forming a fifth transport passage 70 for transporting banknotes from the first transport path 24 to the fourth transport path 27 along the outer face 53 of the second diversion member 51 of the first diversion unit 43 and the side face 61 of the third diversion unit 45, and a sixth transport passage 71 for transporting banknotes from the second transport path 25 to the third transport path 26 along the outer face 53 of the first diversion member 50 of the first diversion unit 43 and the side face 58 of the second diversion unit 44 as shown in FIG. 1(*c*), and banknotes transported from the first transport path 24 and the second transport path 25 can be diverted in three directions.

Figure 5:
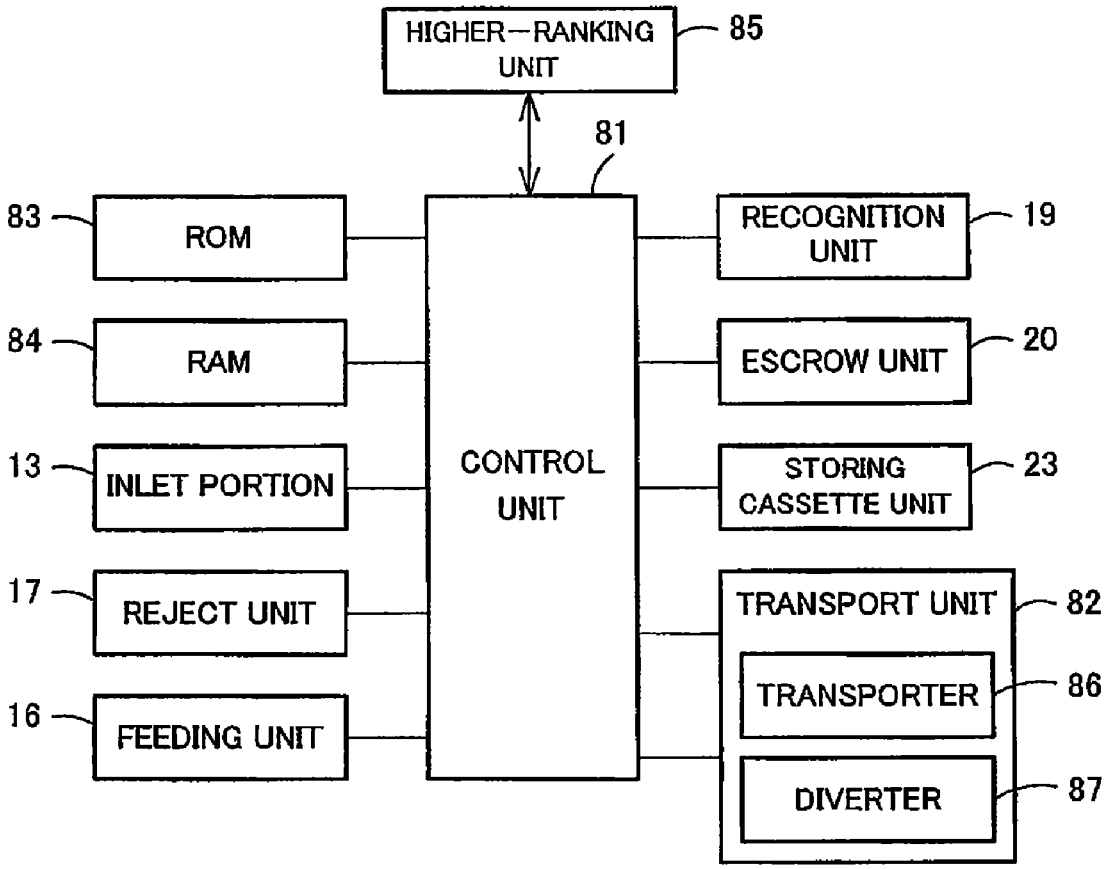
FIG. 5 is a block diagram of the paper sheet processing unit.

FIG. 5 is a block diagram of the banknote depositing unit 11.

The inlet portion 13, reject unit 17, feeding unit 16, recognition unit 19, escrow unit 20, collection cassette unit 23, and a transport unit 82 including the transport paths 14 and 15 are connected to a control unit 81 for controlling the banknote depositing unit 11, and further a ROM 83, in which programs are stored, a RAM 84 for storing data, etc., are connected to the control unit 81. Further, the control unit 81 is communicatively connected to a higher-ranking unit 85 such as an ATM.

The transport unit 82 includes a transporter 86 for transporting banknotes, and a diverter 87 including the transport diverter 28, the two-directional diverters 32, etc.

The control unit 81 controls the stepping motor 56 to switch the stopping position of the first diversion unit 43 to each of the above positions, and diverts banknotes, which are transported from the first transport path 24 and the second transport path 25, in the three directions.

Next, operation of the banknote depositing unit 11 will be described.

Figure 6:
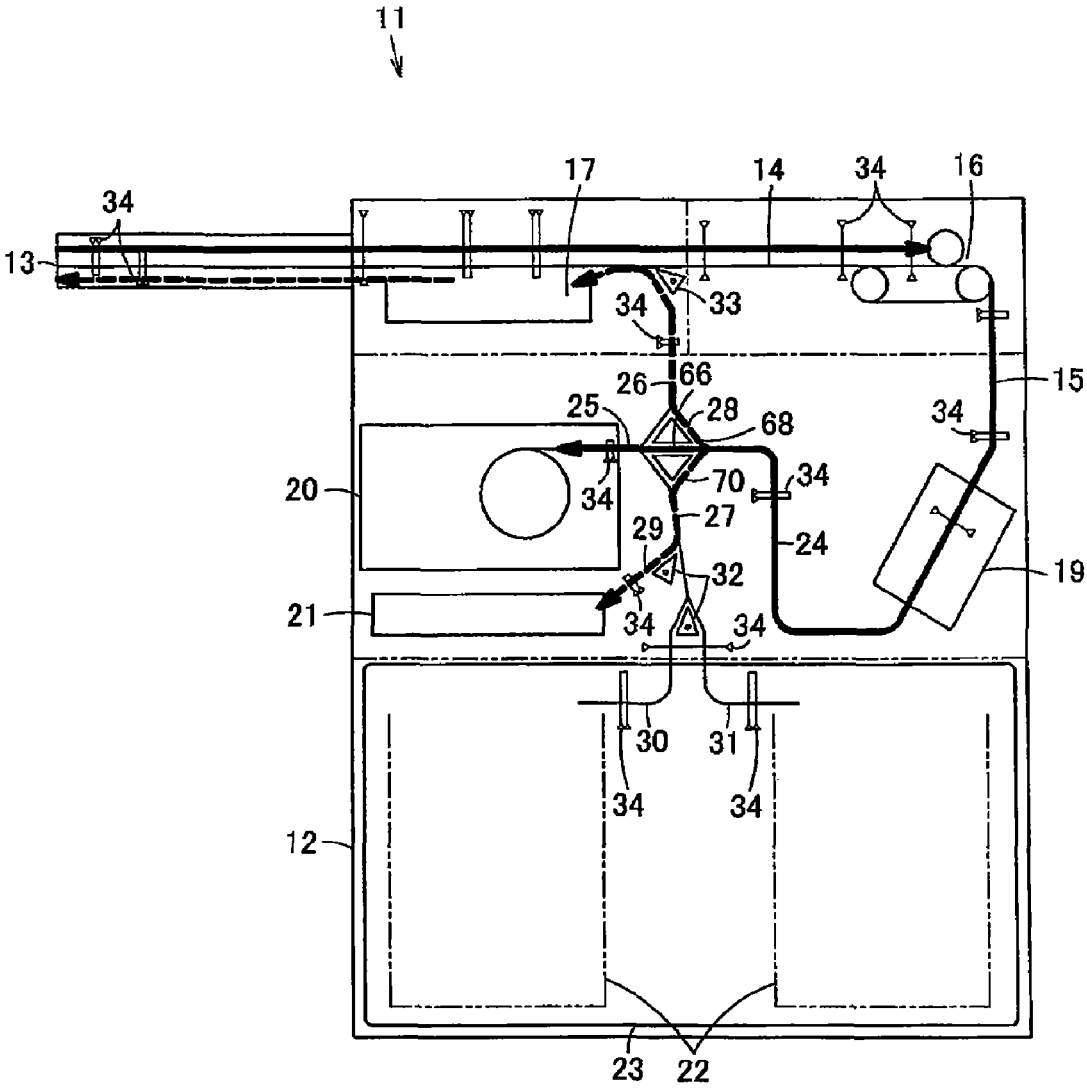
FIG. 6 is an explanatory view explaining a depositing process of the paper sheet processing unit.

As shown in FIG. 6, in the depositing process of the banknote depositing unit 11, banknotes inserted in the inlet portion 13 in a stacked state are taken into the unit body 12 through the transport path 14 as they are, and transported to the feeding unit 16 through the reject unit 17. The stacked banknotes are separated and fed one by one to the transport path 15 by the feeding unit 16, and recognized by the recognition unit 19.

Banknotes each recognized as a normal banknote by the recognition unit 19 are diverted from the first transport path 24 to the second transport path 25 through the first transport passage 66 of the transport diverter 28, and sent and escrowed into the escrow unit 20.

Rejected banknotes each recognized as a non-banknote by the recognition unit 19 are diverted from the first transport path 24 to the third transport path 26 through the third transport passage 68 of the transport diverter 28, and sent and stacked into the reject unit 17. The rejected banknotes stacked in the reject unit 17 are collectively transported and returned to the inlet portion 13 through the transport path 14 as they are (in the case of plurality) after all put-in banknotes have been escrowed in the escrow unit 20 or stacked in the reject unit 17.

Banknotes each recognized as a counterfeit banknote by the recognition unit 19 are diverted from the first transport path 24 to the fourth transport path 27 through the fifth transport passage 70 of the transport diverter 28, and further diverted from the fourth transport path 27 to the fifth transport path 29 by the two-directional diverter 32 and taken into the taking-in box 21.

Figure 7:
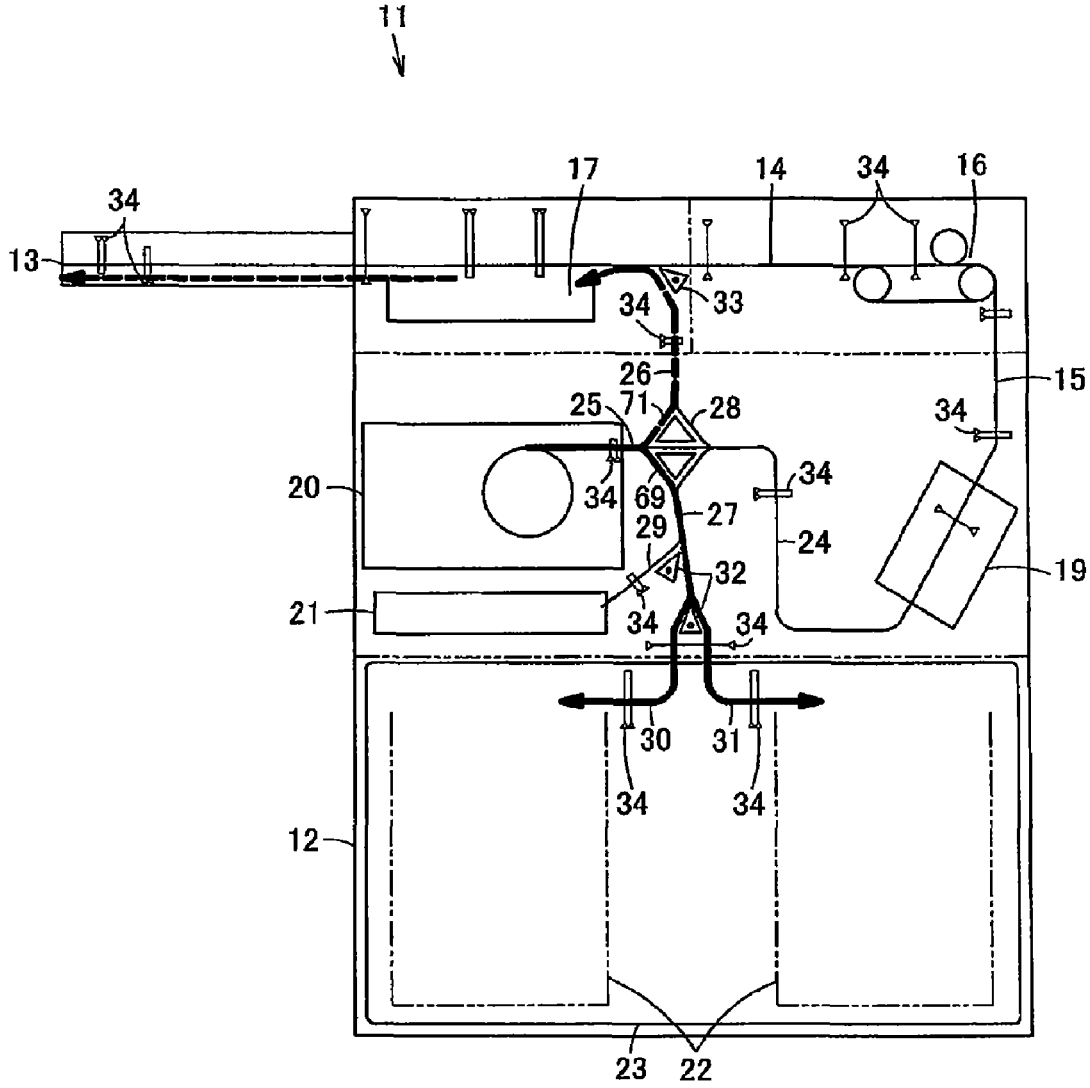
FIG. 7 is an explanatory view explaining a storing process and a returning process of the paper sheet processing unit.

Additionally, as shown in FIG. 7, when a depositing instruction is input from the higher-ranking unit 85 after escrow of banknotes, banknotes escrowed in the escrow unit 20 are fed one by one from the escrow unit 20 to the second transport path 25, diverted from the second transport path 25 to the fourth transport path 27 through the fourth transport passage 69 of the diverter 28, and further diverted from the fourth transport path 27 to the sixth transport path 30 or seventh transport path 31 by the two-directional diverter 32, and sent, stacked and stored into either of the storing units 22.

On the other hand, when a returning instruction is input from the higher-ranking unit 85 after escrow of banknotes, banknotes escrowed in the escrow unit 20 are fed one by one from the escrow unit 20 to the second transport path 25, diverted from the second transport path 25 to the third transport path 26 through the sixth transport passage 71 of the transport diverter 28, and sent and stacked into the reject unit 17. The banknotes stacked in the reject unit 17 are collectively transported and returned to the inlet portion 13 through the transport path 14 as they are after all the banknotes escrowed in the escrow unit 20 have been stacked in the reject unit 17.

Figure 8:
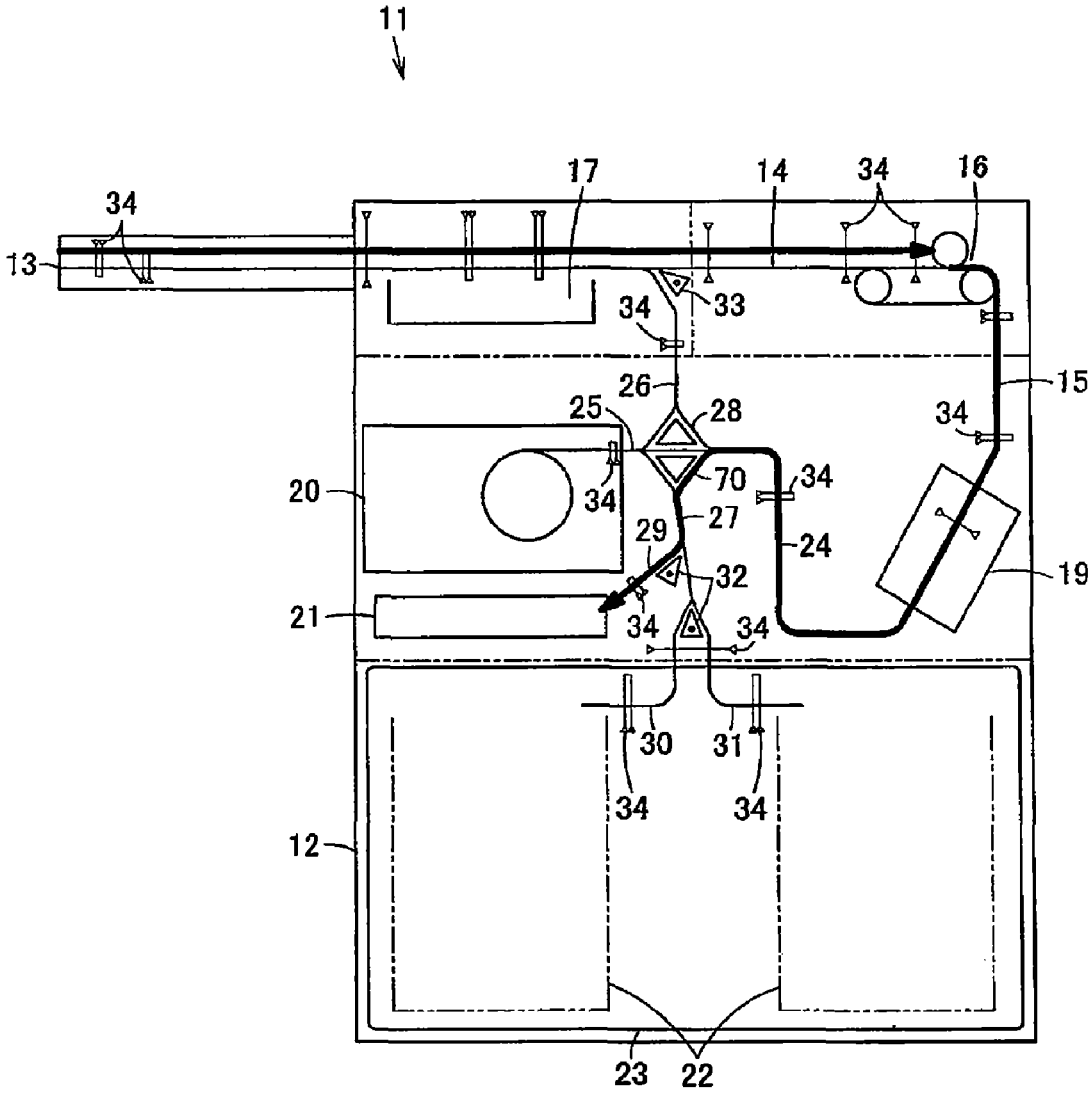
FIG. 8 is an explanatory view explaining a process for taking in a banknote forgotten to be taken out of the paper sheet processing unit.

Additionally, as shown in FIG. 8, when banknotes returned to the inlet portion 13 are not taken out even after passage of a predetermined time, the higher-ranking unit obtaining, from the banknote depositing unit 11, information of detection of the banknotes returned to the inlet portion 13 determines the returned banknotes are forgotten to be taken out, and instructs the banknote depositing unit 11 to take in the banknotes. By the instruction, the banknotes, which are forgotten to be taken out, in the inlet portion 13 are taken in the unit body 12 through the transport path 14 and transported to the feeding unit 16 through the reject unit 17. The banknotes are fed one by one to the transport path 15 by the feeding unit 16, and recognized by the recognition unit 19. The denominations, number, amount, etc., of banknotes forgotten to be taken out are checked by the recognition unit 19.

After recognition by the recognition unit 19, banknotes transported through the first transport path 24 are diverted from the first transport path 24 to the fourth transport path 27 through the fifth transport passage 70 of the transport diverter 28, and further diverted from the fourth transport path 27 to the fifth transport path 29 by the two-directional diverter 32 and taken into the taking-in box 21.

Next, operation of the transport diverter 28 will be described.

The first diversion unit 43 is swung to the first regular position shown in FIG. 1(*b*), and thus the first transport passage 66 for transporting banknotes from the first transport path 24 to the second transport path 25 and the second transport passage 67 for transporting banknotes from the second transport path 25 to the first transport path 24 are formed between the inner face 52 of the first diversion member 50 and the inner face 52 of the second diversion member 51 of the first diversion unit 43.

The first diversion unit 43 is swung to the second regular position shown in FIG. 1(*a*), and thus the third transport passage 68 for transporting banknotes from the first transport path 24 to the third transport passage 26 along the outer face 53 of the first diversion member 50 of the first diversion unit 43 and the side face 58 of the second diversion unit 44 is formed, and the fourth transport passage 69 for transporting banknotes from the second transport path 25 to the fourth transport path 27 along the outer face 53 of the second diversion member 51 of the first diversion unit 43 and the side face 61 of the third diversion unit 45.

The first diversion unit 43 is swung to the third regular position shown in FIG. 1(*c*), and thus the fifth transport passage 70 for transporting banknotes from the first transport path 24 to the fourth transport passage 27 along the outer face 53 of the second diversion member 51 of the first diversion unit 43 and the side face 61 of the third diversion unit 45 is formed, and the sixth transport passage 71 for transporting banknotes from the second transport path 25 to the third transport path 26 along the outer face 53 of the first diversion member 50 of the first diversion unit 43 and the side face 58 of the second diversion unit 44.

Accordingly, the swinging first diversion unit 43 allows banknotes to be transported from/to the first transport path 24 to/from the second transport path 25, the paths 24 and 25 facing each other, and banknotes transported from the first transport path 24 and the second transport path 25 to be diverted in multiple directions, to the third transport path 26, the fourth transport path 27, etc.

Additionally, by using the second diversion unit 44 and third diversion unit 45 with the swinging first diversion unit 43, banknotes diverted by the first diversion unit 43 can be reliably diverted to the third transport path 26 and the fourth transport path 27 through the second diversion unit 44 and the third diversion unit 45.

Thus, by applying the transport diverter 28 to the banknote depositing unit 11, installation places of a plurality of two-directional diverters can be combined into one place and the number of installation places can be reduced.

That is, in depositing banknotes, recognized banknotes can be diverted in three directions, to the escrow unit 20, reject unit 17 and taking-in box 21, at only one place, the transport diverter 28. Regarding taking-in of counterfeit banknotes, in a conventional banknote depositing unit shown in FIG. 11, banknotes each recognized as a counterfeit banknote are stored in an escrow unit 6 together with normal banknotes with memorization of the order of storage thereof, separated when being fed from the escrow unit 6, and stored in a taking-in box 7. Therefore, transport control becomes complicated. However, by application of the transport diverter 28, counterfeit banknotes can be directly taken in the taking-in box 21 through the transport diverter 28 without use of the escrow unit 20.

Banknotes fed from the escrow unit 20 after escrow can be diverted in two directions, to the storing unit 22 and the reject unit 17, at the same diverting position with use of the transport diverter 28 used in depositing.

Figure 11:
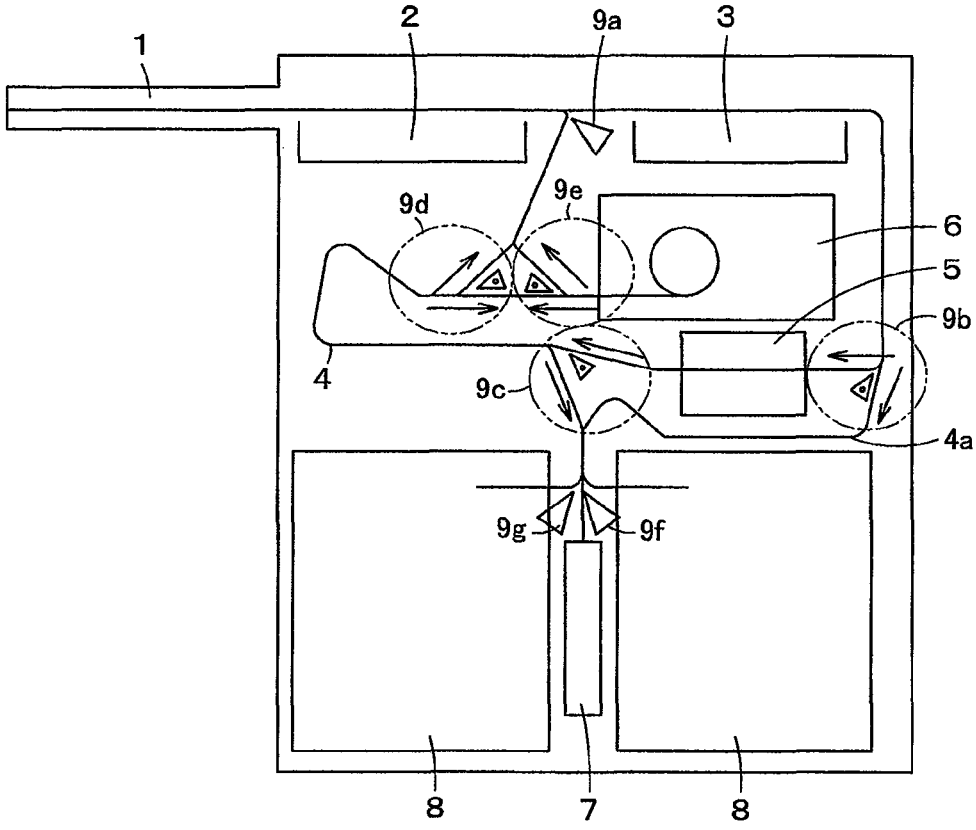
FIG. 11 is a cross sectional view showing an inner structure of a conventional paper sheet processing unit.

Regarding taking-in of banknotes forgotten to be taken out, in the conventional banknote depositing unit shown in FIG. 11, an occupied space with diversion is enlarged due to installation of a plurality of two-directional diverters, and thus a diverter 9*b* is required to be installed in front of a recognition unit 5 when it cannot be provided between the recognition unit 5 and a diverter 9*c*. Thus, a path dedicated to forgetting to take out 4*a* used for only transport of banknotes forgotten to be taken out must be provided. However, by application of the transport diverter 28, banknotes forgotten to be taken out can be taken in the taking-in box 21 through the transport diverter 28.

Therefore, according to the banknote depositing unit 11, a plurality of installation places of two-directional diverters can be combined into one place, the number of places can be reduced, an occupied space necessary for diversion is made smaller than that of the conventional unit, downsizing can be realized, transport control can be simplified and cost can be reduced.

Figure 9:
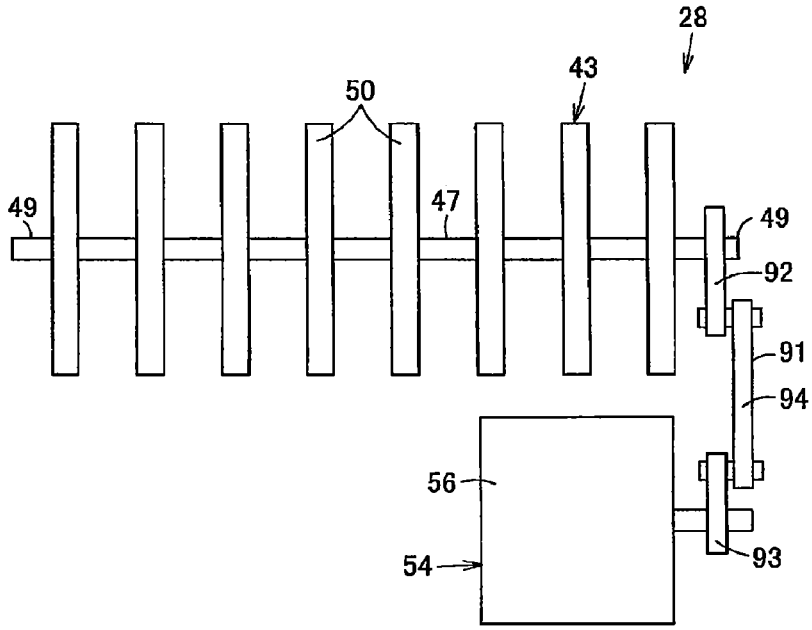
FIG. 9 is a plan view showing a driving structure of a first diversion unit of a transport diverter of a second embodiment.

FIG. 9 shows a second embodiment.

In the driving unit 54, the axis portion 49 of the first diversion unit 43 and the stepping motor 56 may be linked with each other through a linking mechanism 91. In the linking mechanism 91, a linking member 92 fixed to the axis portion 49 of the first diversion unit 43 and a linking member 93 fixed to the driving axis of the stepping motor 56 are linked with each other through a link 94.

By using the linking mechanism 91, the stepping motor 56 is arranged aside of the first diversion unit 43 and the size in the axis direction can be made small.

Figure 10:
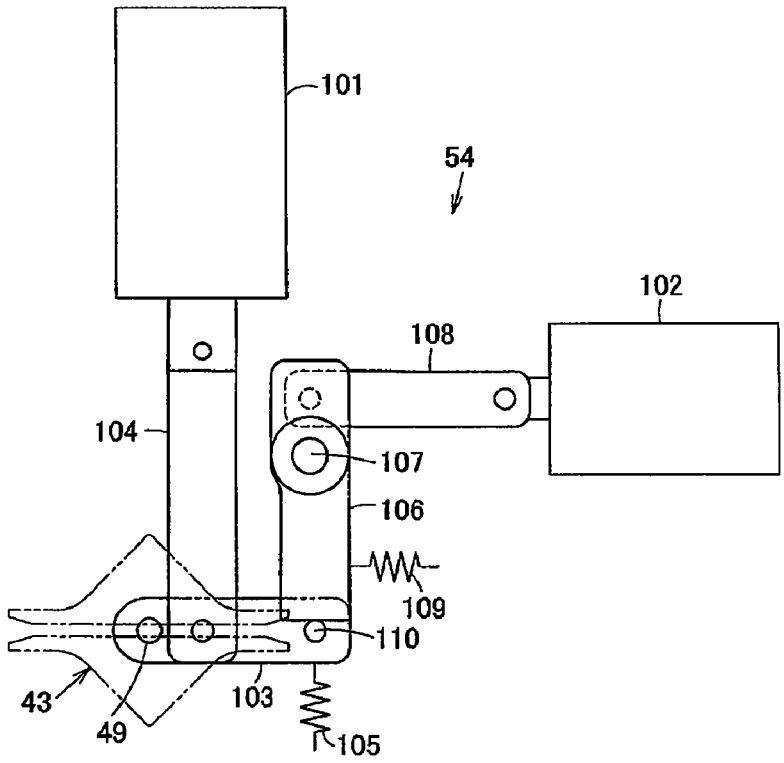
FIG. 10 is a side view showing a driving structure of a first diversion unit of a transport diverter of a third embodiment.

FIG. 10 shows a third embodiment.

As an example of the driving unit 54, solenoids 101 and 102 are used in place of the stepping motor 56. One end of a lever 103 is fixed to the axis portion 49 of the first diversion unit 43, and a plunger 104 of the solenoid 101 is linked with the middle portion of the lever 103. A spring 105 for reversely biasing the lever 103 swung by on-operation of the solenoid 101 is linked with the lever 103. The lever 103 is swung downward by biasing of the spring 105 in an off-state of the solenoid 101, and thus the first diversion unit 43 is swung to the second regular position shown in FIG. 1(*a*). The plunger 104 retreats against the biasing of the spring 105 and the lever 103 is swung upward by the on-operation of the solenoid 101, and thus the first diversion unit 43 is swung to the third regular position shown in FIG. 1(*c*).

A stopper 106 is arranged, swingably around a fulcrum 107, aside of the plunger 104 of the solenoid 101, and a plunger 108 of the solenoid 102 is linked with one end of the stopper 106. A spring 109 for reversely biasing the stopper 106 swung by the on-operation of the solenoid 102 is linked with the stopper 106. A pin 110 is projected on the other end of the lever 103.

The plunger 108 is made to retreat against biasing of the spring 109 by the on-operation of the solenoid 102 in a state where the lever 103 is swung downward by the biasing of the spring 105 in the off-state of the solenoid 101 and the first diversion unit 43 is swung to the second regular position shown in FIG. 1(*a*), and thus the other end of the stopper 106 advances to a position of coming into contact with the pin 110 of the lever 103. Thus, the plunger 104 retreats against the biasing of the spring 105 by the on-operation of the solenoid 101 and the lever 103 is swung upward. Thus, the pin 110 of the lever 103 comes into contact with the stopper 106 and the first diversion unit 43 stops at the first regular position shown in FIG. 1(*b*). Additionally, the lever 103 is swung downward by the biasing of the spring 105 by the off-operation of the solenoid 101, the other end of the stopper 106 is made separate from the position of coming into contact with the pin 110 of the lever 103 by the biasing of the spring 109 by the off-operation of the solenoid 102, and the lever 103 is permitted to be swung upward.

Such a constitution of the driving unit 54 allows cost to be reduced.

Moreover, although the second diversion unit 44 and the third diversion unit 45 are used together with the first diversion unit 43 in the above embodiments, banknotes can be diverted to the third transport path 26 and the fourth transport path 27 by only the first diversion unit 43 without the second diversion unit 44 and third diversion unit 45 in some structures.

Additionally, by making at least one of the second and third diversion units 44 and 45 swingable, banknotes transported from at least one of the third and fourth transport paths 26 and 27 can be diverted to the first transport path 24 and the second transport path 25 and diversion at a further larger number of directions can be realized. Thus, the transport diverter 28 can be applied to not only the banknote depositing unit 11 in the above embodiments but also various paper sheet processing units.

Moreover, although the first diversion member 50 and the second diversion member 51 of the first diversion unit 43 are integrally moved in the above embodiments, they may be separately moved in accordance with a transporting direction and a diverting direction of banknotes. In this case, the first diversion member 50 and the second diversion member 51 may be moved synchronously with each other in accordance with the transporting direction and the diverting direction of banknotes. Alternatively, if the first diversion member 50 and the second diversion member 51 are constituted so as not to interfere with each other, either of the first diversion member 50 and the second diversion member 51 may be moved in accordance with the transporting direction and the diverting direction of banknotes.

Moreover, in the banknote depositing unit 11, banknotes may be directly stored in the storing unit 22 without the escrow unit 20, or a return port portion for returning banknotes may be provided separately from the inlet portion 13.

INDUSTRIAL APPLICABILITY

The present invention is applied to a paper sheet processing unit for processing not only banknotes but also paper sheets such as checks, vouchers and sheets.

The invention claimed is:

1. A transport diverter for diverting transported paper sheets, the transport diverter comprising:

a first transport path;

a second transport path opposite to the first transport path and which paper sheets can be transported to and from the first transport path;

a third transport path transporting paper sheets which are diverted, at a connection point between the first transport path and the second transport path, to one side in a direction crossing a facing direction of the first transport path and the second transport path;

a fourth transport path transporting paper sheets which are diverted, at the connection point, to the other side in the direction crossing the facing direction of the first transport path and the second transport path;

a diversion unit which is swingably provided at the connection point and has a pair of diversion members in which a first diversion member connected to a first supporting unit and a second diversion member connected to a second supporting unit are provided opposite to each other and a linking plate integrally links the pair of supporting units, the pair of diversion members having inner faces facing each other and outer faces opposite from the inner faces, the faces each serving as a transporting face of paper sheets;

a driving unit swinging the diversion unit; and a control unit controlling the driving unit to switch a stopping position of the diversion unit to a position of forming a first transport passage for transporting paper sheets from the first transport path to the second transport path, and a second transport passage for transporting paper sheets from the second transport path to the first transport path between the inner face of the first diversion member and the inner face of the second diversion member of the diversion unit, a position of forming a third transport passage for transporting paper sheets from the first transport path to the third transport path along the outer face of the first diversion member of the diversion unit and a fourth transport passage for transporting paper sheets from the second transport path to the fourth transport path along the outer face of the second diversion member of the diversion unit and a position for forming a fifth transport passage for transporting paper sheets from the first transport path to the fourth transport path along the outer face of the second diversion member of the diversion unit and a sixth transport passage for transporting paper sheets from the second transport path to the third transport path along the outer face of the first diversion member of the diversion unit, and for diverting paper sheets, which are transported from the first transport path and the second transport path, in three directions.

2. A paper sheet processing unit for recognizing put-in paper sheets and determining a transport destination of a paper sheet in accordance with a recognition result, the paper sheet processing unit comprising:

a transport path transporting put-in paper sheets;

a recognition unit recognizing paper sheets transported through the transport path; and the transport diverter according to claim 1 provided on the transport path and diverts a paper sheet, which has been recognized by the recognition unit, in accordance with a transport destination to which the paper sheet is transported.

3. A transport diverter for diverting transported paper sheets, the transport diverter comprising:

a first transport path;

a second transport path opposite to the first transport path and which paper sheets can be transported to and from the first transport path;

a third transport path for transporting paper sheets which are diverted, at a connection point between the first transport path and the second transport path, to one side in a direction crossing over a facing direction of the first transport path and the second transport path;

a fourth transport path transporting paper sheets which are diverted, at the connection point, to the other side in the direction crossing the facing direction of the first transport path and the second transport path;

a first diversion unit which is swingably provided at the connection point and has a pair of diversion members in which a first diversion member connected to a first supporting unit and a second diversion member connected to a second supporting unit are provided opposite to each other and a linking plate integrally links the pair of supporting units, the pair of diversion members having inner faces facing each other and outer faces opposite from the inner faces, the faces each serving as a transporting face of paper sheets;

a second diversion unit provided between the first diversion unit and the third transport path, and having side faces each serving as a transporting face of paper sheets;

a third diversion unit provided between the first diversion unit and the fourth transport path, and having side faces each serving as a transporting face of paper sheets;

a driving unit swinging the first diversion unit; and a control unit controlling the driving unit to switch a stopping position of the first diversion unit to a position of forming a first transport passage for transporting paper sheets from the first transport path to the second transport path, and a second transport passage for transporting paper sheets from the second transport path to the first transport path between the inner face of the first diversion member and the inner face of the second diversion member of the first diversion unit, a position of forming a third transport passage for transporting paper sheets from the first transport path to the third transport path along the outer face of the first diversion member of the first diversion unit and the side face of the second diversion unit and a fourth transport passage for transporting paper sheets from the second transport path to the fourth transport path along the outer face of the second diversion member of the first diversion unit and the side face of the third diversion unit and a position for forming a fifth transport passage for transporting paper sheets from the first transport path to the fourth transport path along the outer face of the second diversion member of the first diversion unit and the side face of the third diversion unit and a sixth transport passage for transporting paper sheets from the second transport path to the third transport path along the outer face of the first diversion member of the first diversion unit and the side face of the second diversion unit, and for diverting paper sheets, which are transported from the first transport path and the second transport path, in three directions.

4. A paper sheet processing unit for recognizing put-in paper sheets and determining a transport destination of a paper sheet in accordance with a recognition result, the paper sheet processing unit comprising:

a transport path transporting put-in paper sheets;

a recognition unit recognizing paper sheets transported through the transport path; and the transport diverter according to claim 3 provided on the transport path and diverts a paper sheet, which has been recognized by the recognition unit, in accordance with a transport destination to which the paper sheet is transported.

* * * * *